United States Patent [19]

Wolford

[11] Patent Number: 4,684,132

[45] Date of Patent: Aug. 4, 1987

[54] DEVICE FOR HOLDING PLAYING CARDS AND THE LIKE

[76] Inventor: Russel E. Wolford, Rte. 4, Kearney, Nebr. 68847

[21] Appl. No.: 789,652

[22] Filed: Oct. 21, 1985

[51] Int. Cl.[4] ..... A63F 1/10

[52] U.S. Cl. ..... 273/150; 40/124

[58] Field of Search ..... 273/150, 347, 403, 404, 273/408; 40/124, 124.2, 124.4

[56] References Cited

U.S. PATENT DOCUMENTS

| | | | |
|---|---|---|---|
| D. 262,727 | 1/1982 | Snyder . | |
| 753,538 | 3/1904 | Bristow . | |
| 986,665 | 3/1911 | Wilder | 273/150 |
| 1,076,850 | 10/1913 | Wedderburn . | |
| 2,210,149 | 8/1940 | Levine et al. | 273/403 |
| 2,474,763 | 10/1945 | Thomas . | |
| 3,300,216 | 1/1967 | Haecker | 273/403 |
| 3,767,057 | 10/1973 | Holmes . | |
| 4,468,032 | 8/1984 | Stewart . | |

FOREIGN PATENT DOCUMENTS

| | | | |
|---|---|---|---|
| 520858 | 1/1956 | Canada | 273/404 |
| 16076 | of 1891 | United Kingdom . | |
| 310882 | 3/1928 | United Kingdom . | |

*Primary Examiner*—Anton O. Oechsle

*Attorney, Agent, or Firm*—E. Robert Newman

[57] ABSTRACT

A card holder having a base with a depression into which a pack of paper sheets bound along one edge are affixed. The bound edge is affixed in the depression to allow the free ends of the paper sheets to receive and hold cards in an upright position. Staggered nails through opposing faces of the pack form the binding.

7 Claims, 3 Drawing Figures

DEVICE FOR HOLDING PLAYING CARDS AND THE LIKE

TECHNICAL FIELD

The present invention relates generally to playing card holders, and more particularly card holders which make card playing feasible for the handicapped and others in certain situations.

BACKGROUND ART

Difficulties in playing card games for handicapped adults, are in many ways similar to those encountered by small children. Children have difficulty in sorting and arranging the cards, and then in holding them so that they can see each individual card. Problems are not over once the cards are dealt. They may persist throughout the length of the game. It can be even more difficult to hold cards in an arranged state than to initially sort them. In many games selecting and withdrawing a card from the hand requires another rearrangement of the cards.

None of the known card holders would suffice to permit a person completely disabled on one side and partially on the other to participate in a game such as contract bridge. The partially disabled hand could not grip a fanned hand of cards, nor would a second hand be available to insert and remove selected cards. In addition were such a party confined to a wheel chair, he or she might not be able to have close enough access to a card table to play games with others or to play games such as solitaire.

Thus, it can be seen that the problems to be solved by a card holding device do not stop at merely holding a number of cards in a convenient arrangement. The card holding device must also be directed towards ease in removing cards from the holder without disturbing the remaining arrangement. Moreover, the cardholder should be self-supporting, so that it may rest on the lap, or on the arms of a wheel chair, and allow the user to freely use his hands in sorting, arranging, and selecting cards.

DISCLOSURE OF THE INVENTION

It is therefore a general object of the present invention to provide a new and novel device for holding playing cards.

Another object is to provide a card holder which allows easy insertion and withdrawal of the cards.

Yet another object of the present invention is to provide a card holder which can receive and hold a full hand of cards, or stacks of cards for solitaire games, and display them for easy reading.

A further object is to provide a card holder which is self-supporting, and can be used away from a card table.

Yet a further object is to provide a card holder which will support cards vertically so as not to be viewed by others, and yet allow easy arrangement, rearrangement and withdrawal of cards.

More generally, it is an object of the present invention to provide a card holder which has a base with a depression in its upper face for holding a pack of paper sheets bound together along one edge. The sheets are bound together with nails driven through their opposing sides in staggered locations. The bound edge of the pack of paper sheets is glued into the base depression for support of the lower portion of the pack. Cards inserted between the paper sheets will remain in place until withdrawn.

These and other objects, advantages and novel features of the present invention will become apparent from the following detailed description of the invention when considered in conjunction with the accompanying drawings.

BEST MODE FOR CARRYING OUT THE INVENTION

Figure 1:
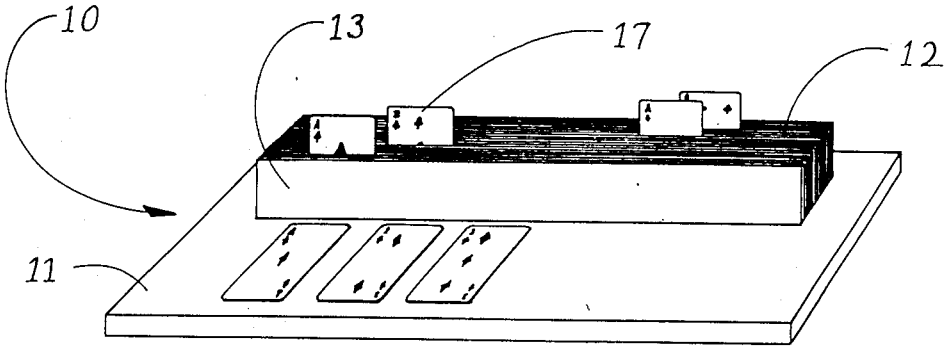
FIG. 1 is a perspective view of the card holding device.
Figure 2:
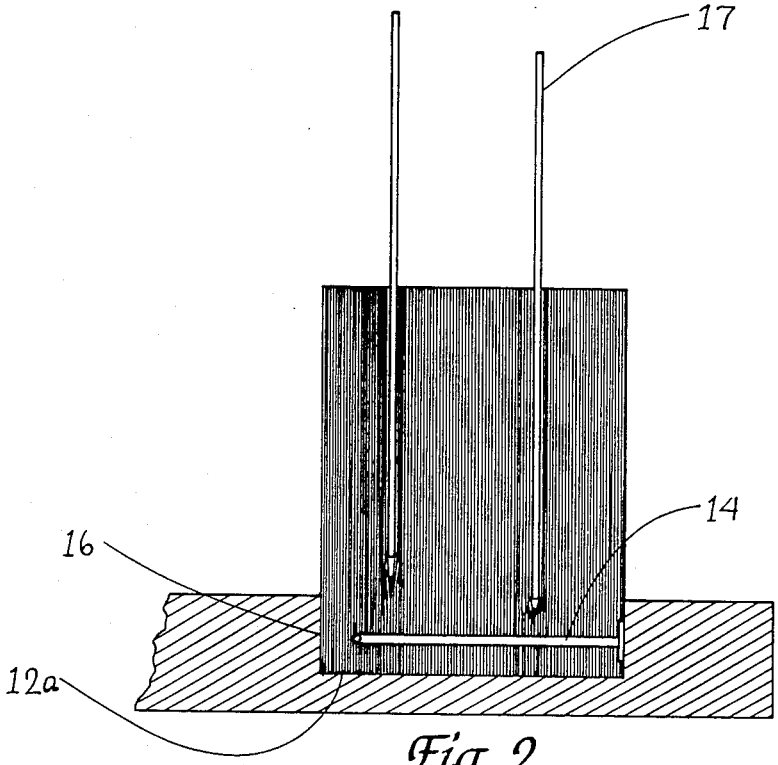
FIG. 2 is an enlarged partial sectional view of the device taken at lines 2—2 in FIG. 1.
Figure 3:
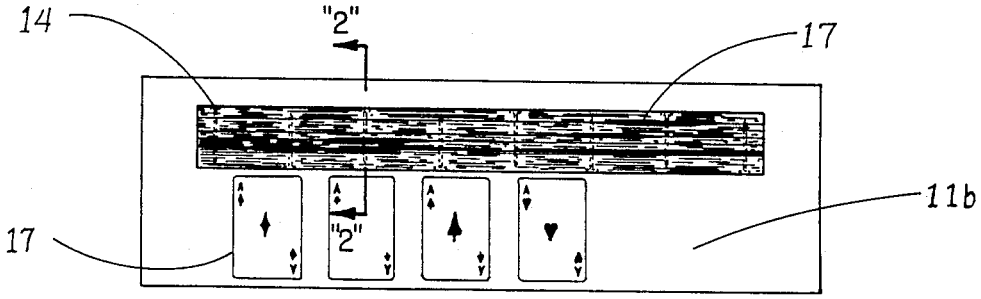
FIG. 3 is a top view of the card holding device.

Referring now to the drawings in which identical or corresponding parts are indicated by the same reference character throughout the several views, and more particularly to FIG. 1, the card holding device is designated generally at 10 and includes a rectangular planar base 11 and a plurality of stiff paper sheets 12 bound along one longitudinal edge 12*a* (See FIG. 2) to form a pack 13. The inventor has found that paper known as "Carnival Text" works well for this purpose. Approximately 180 sheets of "Carnival Text" paper cut about 2" to 2½" high and 20" long will form a pack about 2" in width and fit into a base about 24" long. This base, if 7" wide fits handily on a card table as well as on one's lap. Referring now to FIGS. 2 and 3, the paper sheets 12 may be simply and inexpensively bound together using nails 14 which are driven through the stack of sheets near their lower edges. As seen in FIG. 3 nails 14 on one side of pack 13 are staggered with respect to those on the other side to allow them to be nearly as long as the width of pack 13. The use of nails 14 has the advantage of avoiding any tendency for glue to seep between the sheets 12 and spread them apart. Nails are also a positive safeguard against any sheets being pulled upwards as cards are removed.

The upper face 11*a* of base 11 has a depression of a length slightly greater than the length of paper sheets 12, and of a width slightly greater than the depth of pack 13. Depression 16 may be routed if base 11 is of wood or molded if it is of plastic or other material. Depression 16 has a depth sufficient to conceal the heads of nails 14 and to provide additional bias against the removal of cards along the lower portion of pack 13. Pack 13 is glued to the bottom of depression 16. The height of pack 13 is such that when a playing card 17 is inserted between any two sheets 12 its value and suit marking will remain exposed. Due to the tightness of pack 13 no playing card 17 may be easily jammed below the height of the top of upper face 11*a* of base 11.

In operation, playing cards 17 are inserted between sheets 12 and are held in place by the horizontal biasing force of sheets 12 as each card 17 attempts to spread the adjacent sheets 12 apart. The use of as many of 180 sheets 12 gives a handicapped user a wide target within which to insert each card. Much like pushing a pin into a pin cushion, each card 17 may be inserted near the front or back, right or left sides, and may be arranged in vertical or horizontal columns for viewing. Enough room may be left around a card 17 to allow fo easy grasping and removal.

Base 11 also incorporates an area 11*b* in front of depression 16 which may be used in conjunction with pack 13 for certain games, such as solitaire, while base 11 is on one's lap. Thus, the user is not required to sit at a table in order to play a game and one confined to a wheel chair may more easily participate with others at a table.

Obviously, card holder 10 may also used for other purposes as well, such as for holding recipe cards, letters, bills, etc.

It will be readily understood that the particular disposition or arrangement or nature of the elements of the invention are not of the essence of the invention, and that many variations, substitutions, and modifications may be made, in departure from their particular construction and characterization in the drawings and foregoing description, without departing from the true spirit of the invention. It is therefore to be understood that the invention should be limited only by the breadth and scope of the appended claims.

What is claimed is:

1. A playing card holder, comprising:

a plurality of equal-sized paper sheets bound together along one edge to form a pack, said pack affixed along said binding to the upper face of a base board, wherein the bound edge and the adjacent portion of the sheets in said pack are in face to face contact with each other, whereby adjacent sheets will be biased against the removal of playing cards inserted between them, and wherein the means for binding the sheets together includes a plurality of nails, of a length less than the depth of said pack of sheets, driven in a staggered arrangement from opposing faces of said pack and adjacent the lower edge.

2. The playing card holder of claim 1, wherein the distance from the bound edge to the upper edge of the affixed pack of sheets is less than the distance from the lower edge of a conventional playing card, to the uppermost value and suit characters on the card, whereby a playing card's value and suit will always be displayed to the user.

3. The playing card holder of claim 2, wherein said base includes a playing surface extending from one face of said pack of sheets a distance greater than the length of a conventional playing card.

4. The playing card holder of claim 3, wherein said base is further characterized as having a depression cut in its upper face of slightly greater length and width than the binding side of said pack into which said pack is affixed, whereby the walls of said depression give further support to the binding.

5. The playing card holder of claim 1, wherein said base includes a playing surface extending from one face of said pack of sheets a distance greater than the length of a conventional playing card.

6. The playing card holder of claim 1, wherein said base is further characterized as having a slot cut in its upper face, into which said binding is affixed.

7. A playing card holder comprising:

a plurality of equal-sized flexible sheets bound together along one edge to form a pack, said pack affixed along said binding to the upper face of a base board, wherein the bound edge and the adjacent portion of the sheets in said pack are in face to face contact with each other, whereby adjacent sheets will be biased against the removal of playing cards inserted between them and wherein the means for binding the sheets together includes a plurality of nails, of a length less than the depth of said pack of sheets, driven in a staggered arrangement from opposing faces of said pack and adjacent the lower edge; and a generally horizontal support surface for supporting said base.

* * * * *